US005457295A

United States Patent [19]

Tanibe et al.

[11] Patent Number: 5,457,295

[45] Date of Patent: Oct. 10, 1995

[54] CIRCUIT BREAKER

[75] Inventors: Toshiyuki Tanibe; Hiroshi Fujii; Hiroshi Fujii; Shinji Yamagata; Shinsaku Yamasaki; Tsukasa Iio; Yoshiaki Kobayashi; Setsuo Hosogai; Kouhei Fujiwara; Shirou Murata, all of Hiroshima, Japan

[73] Assignee: Mitsubishi Denki Kabushiki Kaisha, Tokyo, Japan

[21] Appl. No.: 125,175

[22] Filed: Sep. 23, 1993

[30] Foreign Application Priority Data

Sep. 28, 1992 [JP] Japan ..... 4-257723
Sep. 28, 1992 [JP] Japan ..... 4-257724

[51] Int. Cl.[6] ..... H01H 1/64

[52] U.S. Cl. ..... 200/293; 200/401; 200/43.11; 200/43.14; 200/43.15

[58] Field of Search ..... 200/401, 43.11, 200/43.14, 43.15, 333, 293, 43.16, 43.19, 43.21, 50 A

[56] References Cited

U.S. PATENT DOCUMENTS 4,074,091 2/1978 Bischof et al. ..... 200/504 A
4,754,247 6/1988 Raymont et al. .
4,794,356 12/1988 Yu et al. ..... 200/331
4,894,631 1/1990 Castonguay et al. ..... 200/43.14
4,978,816 12/1990 Castonguay et al. ..... 200/43.14
5,113,043 5/1992 Morris .
5,219,070 6/1993 Grunert et al. ..... 200/43.11

FOREIGN PATENT DOCUMENTS 0049209 4/1982 European Pat. Off. .
0358482 3/1990 European Pat. Off. .
58-8888 7/1956 Japan .
7806025 6/1978 Japan .
3-62430 6/1991 Japan .

*Primary Examiner*—Henry J. Recla
*Assistant Examiner*—David J. Walczak
*Attorney, Agent, or Firm*—Burns, Doane, Swecker & Mathis

[57] ABSTRACT

A circuit breaker-includes: a casing having a base and a main cover secured to the base, the casing accommodating a circuit breaking mechanism; a recesses formed in one surface of the main cover, the opposite surface of which is on the side of the base, the recess being adapted to receive an auxiliary device of the circuit breaking mechanism; and an auxiliary cover mounted on the main cover in such a manner as to close the recess. The circuit breaker is automatically tripped when the auxiliary cover is opened, thus permitting installation of the auxiliary device thereon with high security.

19 Claims, 14 Drawing Sheets

PRIOR ART

PRIOR ART

CIRCUIT BREAKER

BACKGROUND OF THE INVENTION

This invention relates to a circuit breaker with auxiliary devices such as a warning switch and an auxiliary switch.

A conventional circuit breaker will be described with reference to FIGS. 21 through 27. FIG. 21 is a perspective view showing the external appearance of the conventional circuit breaker. FIG. 22 is an exploded perspective view of the circuit breaker. FIG. 23 is a sectional view taken along line 23—23 in FIG. 21, showing the circuit breaker which is in an "on" state. FIG. 24 is also a sectional view taken along line 23—23 in FIG. 21, showing the circuit breaker which is in an "off" state. FIG. 25 is a sectional view taken along line 23—23 in FIG. 21, showing the circuit breaker which is in a "trip" state. FIG. 26 is a sectional view taken along line 26—26 in FIG. 22, showing an auxiliary cover. FIG. 27 is a perspective bottom view of the auxiliary cover.

In those figures, reference numeral 1 designates a circuit breaker casing comprising a base 1*a*, and a main cover 1*b* which is detachably secured to the base 1*a*; 2, an auxiliary device such as a warning switch and an auxiliary switch; 3, a recess formed in one surface of the main cover 1*b* which is opposite to the other surface which is on the side of the base 1*a*, for receiving the auxiliary device 2; 5, a movable piece which is swingably mounted inside the circuit breaker casing 1, having a movable contact 5*a*; and 6, a stationary piece with a stationary contact 6*a* which is brought into and out of engagement with the movable contact 5*a*; 7, a handle which is pushed back and forth to swing the movable piece 5 with the aid of a toggle link mechanism 8. The handle 7 comprises: a arcuate base 7*a* which is moved along the inner surface of the main cover 1*b*, and an operating protrusion 7*b* which is extended outwardly from the arcuate base 7*a* through an opening of the main cover 1*b*. Further in those figures, reference numeral 9 designates a lever operated in association with the toggle link mechanism 8; 10, a trip cover coupled to the lever 9 through an engaging metal part 11 and a latch 12; and 13, a tripping mechanism (of bimetal type or electromagnetic type) which is connected to a terminal board 14 on the side of load and connected through a flexible stranded wire 15 to the movable piece 5.

The operation of the conventional circuit breaker thus constructed will be described.

It is assumed that the circuit breaker is held turned on. When, under this condition, the handle 7 is moved in the direction of the arrow 16, the toggle link mechanism 8 is bent, whereby the movable piece 5 is raised. As a result, the circuit breaker is turned off as shown in FIG. 24. When, under this condition, the handle 7 is moved in the direction of the arrow 17 as shown in FIG. 24, the toggle link mechanism 8 is stretched, whereby the movable piece 5 is depressed. As a result, the circuit breaker is turned on as shown in FIG. 23. When over-current flows in the circuit breaker in the "on" state as shown in FIG. 23, the tripping mechanism 13 is operated to turn the trip bar 10 in the direction of the arrow 18, so that the engaging metal part 11 and the latch 12 are disengaged, and the lever 9 is elastically raised. As a result, the toggle link mechanism is bent to raise the movable piece 5. Thus, the circuit breaker is placed in the "trip" state as shown in FIG. 25.

The conventional circuit breaker designed as described above suffers from the following difficulty: Installation of the auxiliary device 2 in the recess 3 with the auxiliary cover 4 removed as shown in FIG. 22 may be hazardous, because when the circuit breaker is in "on" state as shown in FIG. 23, the line connected to it is hot, and it may be tripped unintentionally.

SUMMARY OF THE INVENTION

Accordingly, an object of this invention is to provide a circuit breaker high in reliability on which an auxiliary device can be installed with high security.

The foregoing object of the invention has been achieved by the provision of a circuit breaker which is so designed that, when the circuit breaker is in the "on" state, opening its auxiliary cover is inhibited.

According to a first aspect of the invention, the circuit breaker is so designed that it is placed in the "trip" state when the auxiliary cover is opened.

According to a second aspect of the invention, in the circuit breaker, opening the auxiliary cover is inhibited when the circuit breaker is in the "on" state.

BRIEF DESCRIPTION OF THE DRAWING(S)

DETAILED DESCRIPTION OF THE PREFERRED EMBODIMENTS

First Embodiment

Figure 1:
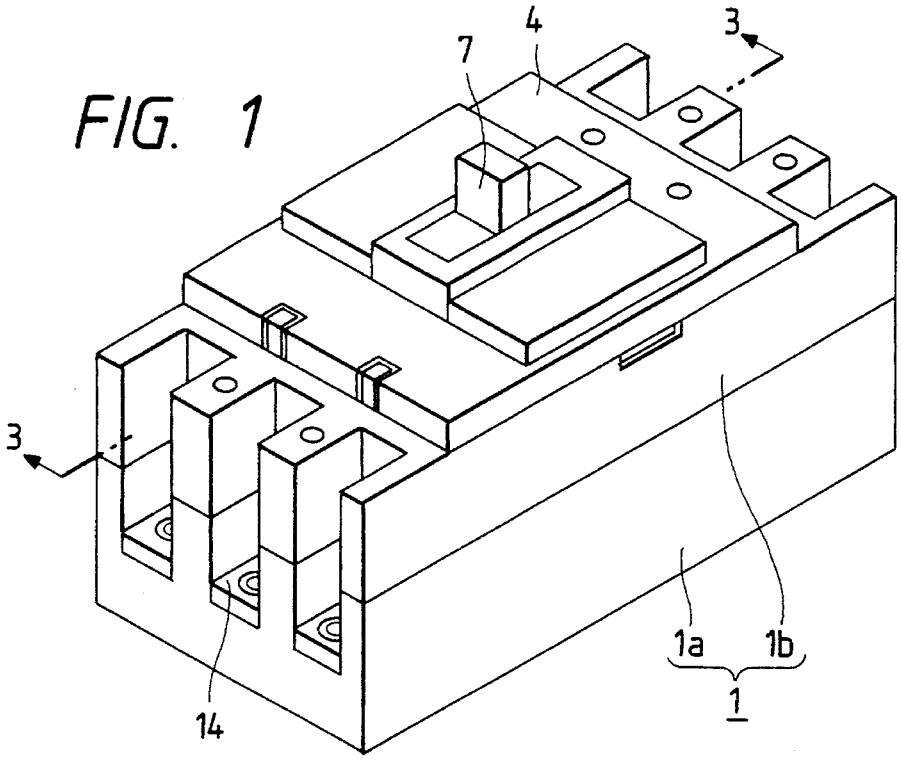
FIG. 1 is a perspective view showing the external appearance of a first embodiment of this invention.
Figure 2:
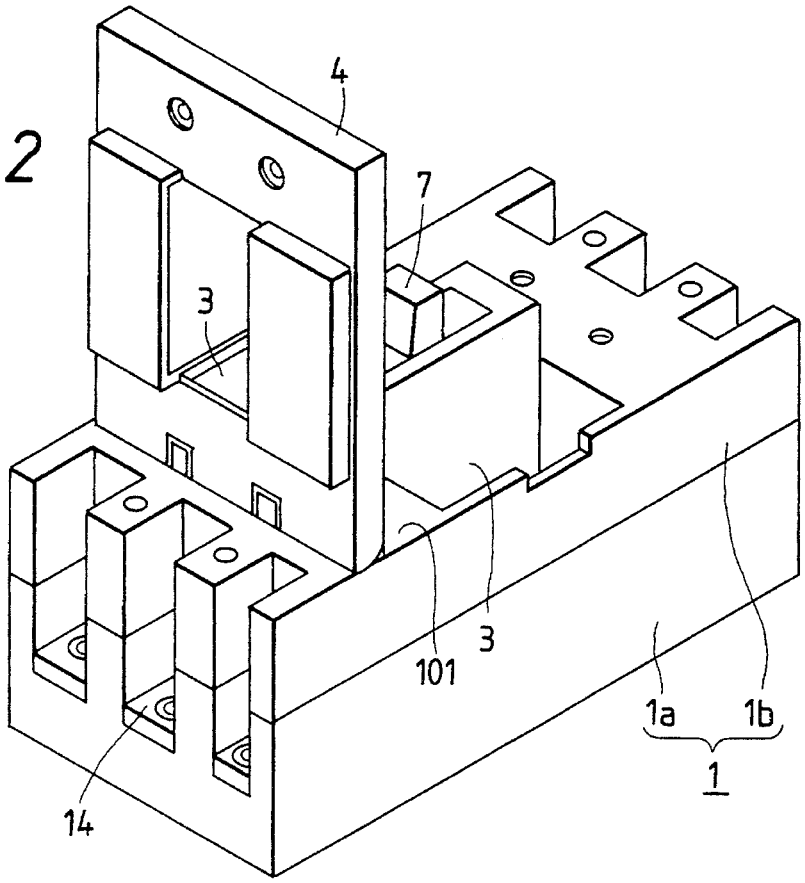
FIG. 2 is a perspective view showing the first embodiment with its auxiliary cover opened.
Figure 3:
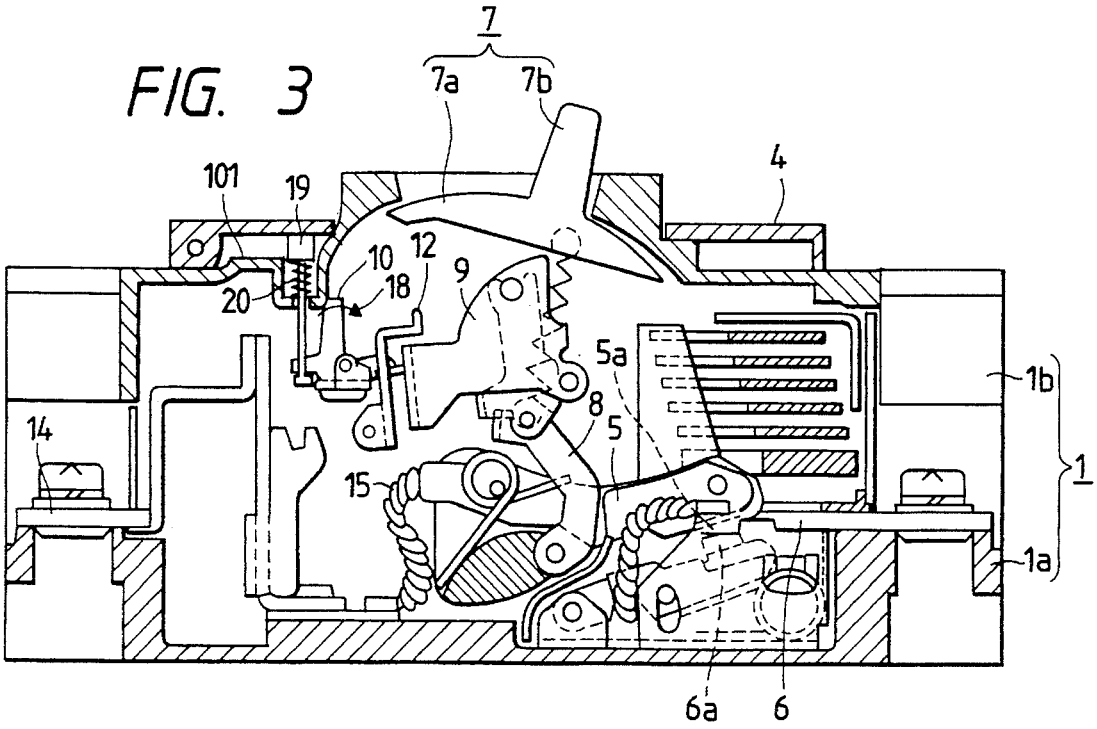
FIG. 3 is a sectional view taken along line 3—3 in FIG. 1.

An example of a circuit breaker, which forms a first embodiment of this invention, will be described with reference to FIGS. 1 through 3. FIG. 1 is a perspective view showing the external appearance of the circuit breaker; FIG. 2 is a perspective view showing the circuit breaker with its auxiliary cover removed, and FIG. 3 is a sectional view taken along line 3—3 in FIG. 1. In those figures, parts corresponding functionally to those which have been described with reference to the conventional circuit breaker are therefore designated by the same reference numerals or characters.

In FIG. 3, reference numeral 19 designates a rod engaged with the trip bar 10, the rod 19 being protruded above through the surface 101 of the main cover 1*b*; and 20, a spring for maintaining the rod 19 protruded as described above.

In the case where the auxiliary cover 4 is closed as shown in FIG. 1, the rod 19 is pushed down against the elastic force of the spring 20. When the auxiliary cover 4 is opened as shown in FIG. 2, the rod 19 is allowed to stick out by the elastic force of the spring 20, so that the trip bar 10 is turned in the direction of the arrow 18, whereby the circuit breaker is tripped.

Second Embodiment

Figure 4:
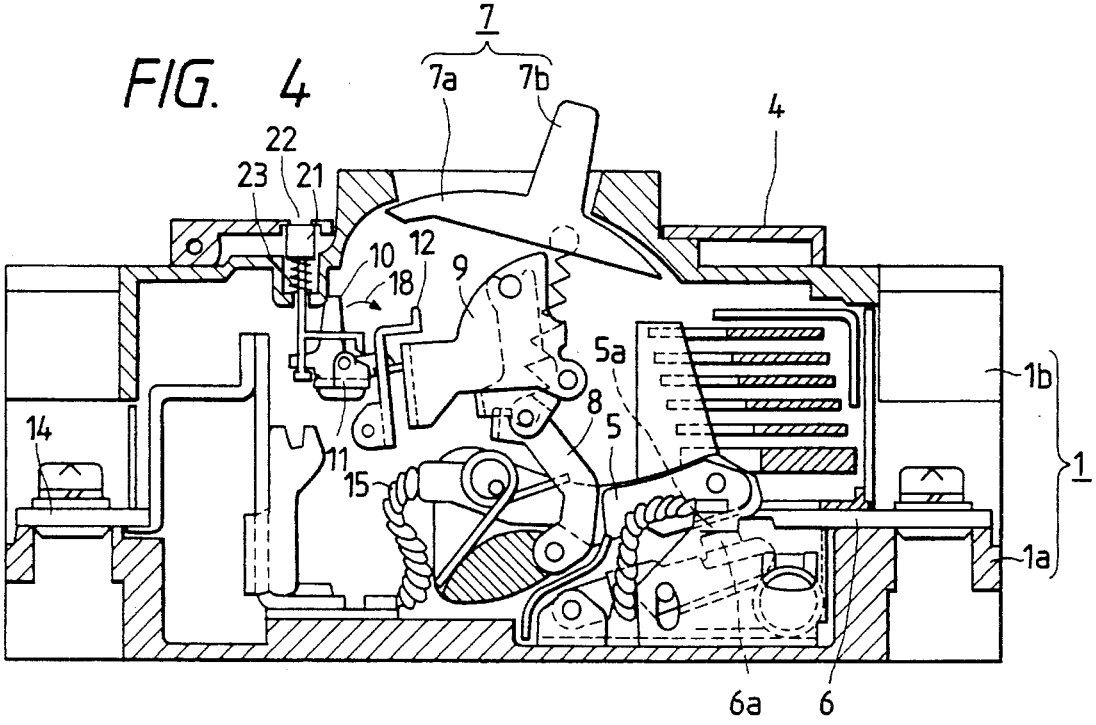
FIG. 4 is a sectional view showing a second embodiment of the invention.

Another example of the circuit breaker, which forms a second embodiment, is as shown in FIG. 4.

The circuit breaker includes a trip button 21 which is manually operated. The trip button 21 is so designed that it is able to stick out, and it is held inside the auxiliary cover 4. In the case where the auxiliary cover 4 is closed as shown in FIG. 4, the circuit breaker is tripped by pushing the trip button 21 through a hole 22 formed in the auxiliary cover 4. When the auxiliary cover 4 is opened as shown in FIG. 2, the trip button 21 is allowed to stick out by the elastic force of a spring 23, so that the trip bar 10 is swung in the direction of the arrow 18, whereby the circuit breaker is tripped.

Third Embodiment

Figure 5:
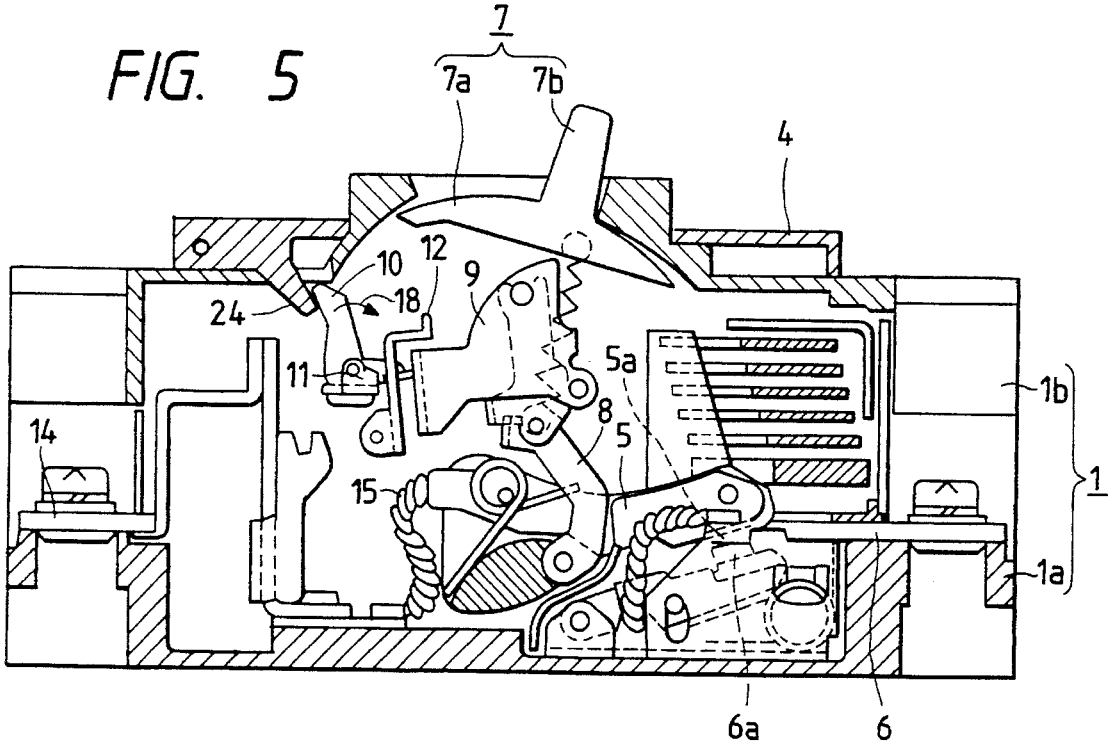
FIG. 5 is a sectional view showing a third embodiment of the invention.
Figure 6:
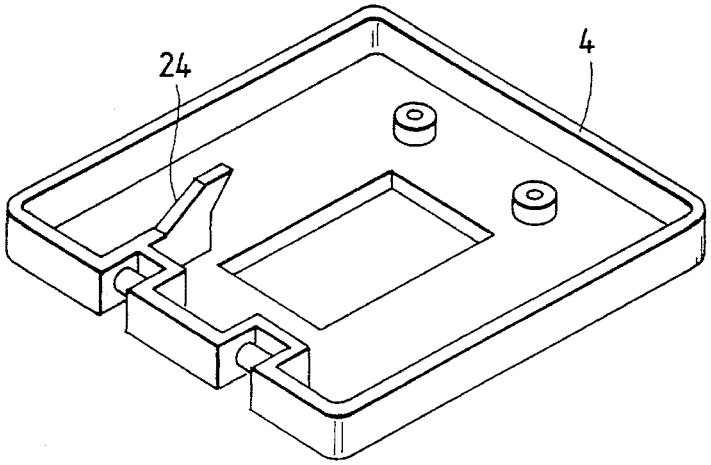
FIG. 6 is a perspective view of an auxiliary cover of the third embodiment.

Another example of the circuit breaker, which forms a third embodiment, will be described with reference to FIGS. 5 and 6.

In the circuit breaker, the auxiliary cover 4 has a protrusion 24 which is adapted to elastically raise the trip bar 10. When the auxiliary cover 4 is opened, the protrusion 24 elastically raises the trip bar 10 to swing the latter 10 in the direction of the arrow 18, so that the circuit breaker is tripped.

As was described above, in each of the first, second and third embodiments of the invention, the circuit breaker is automatically tripped upon opening of the auxiliary cover. Therefore, installation of the auxiliary device on the circuit breaker can be achieved with high security and with high reliability.

Fourth Embodiment

Figure 7:
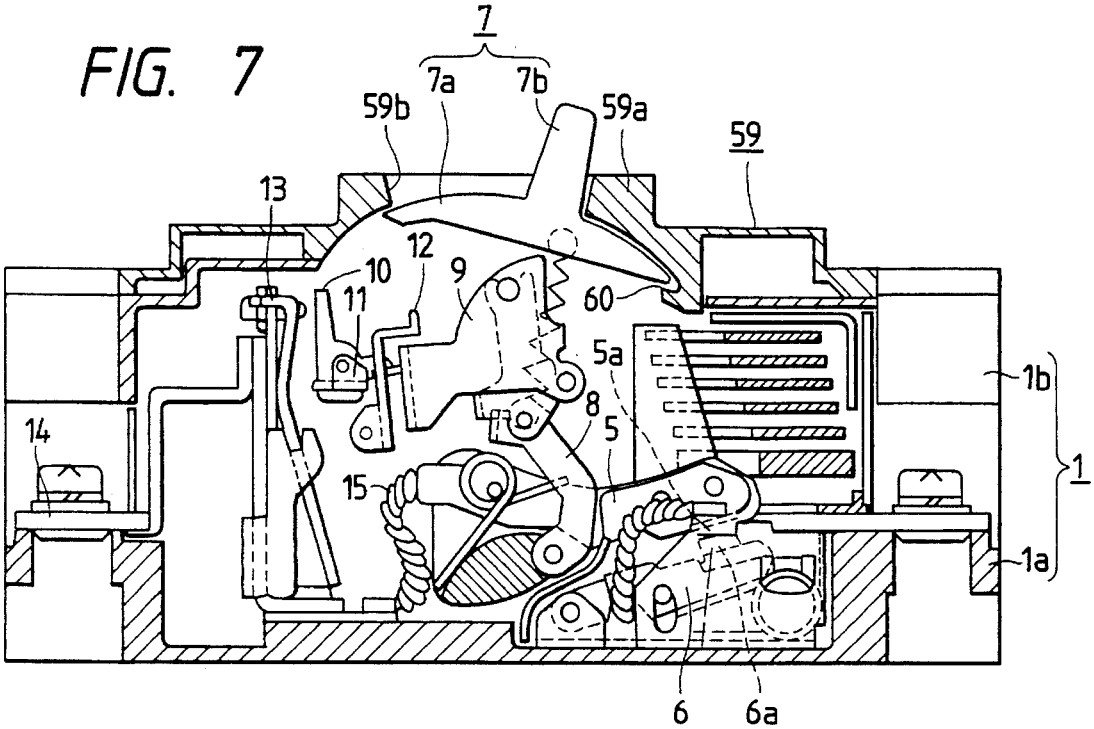
FIG. 7 is a sectional view showing a fourth embodiment of the invention which is in the "on" state.
Figure 8:
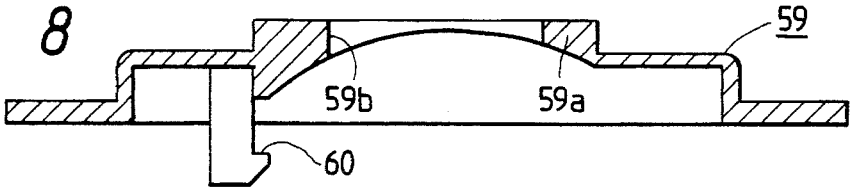
FIG. 8 is a sectional view showing an auxiliary cover of the fourth embodiment.
Figure 9:
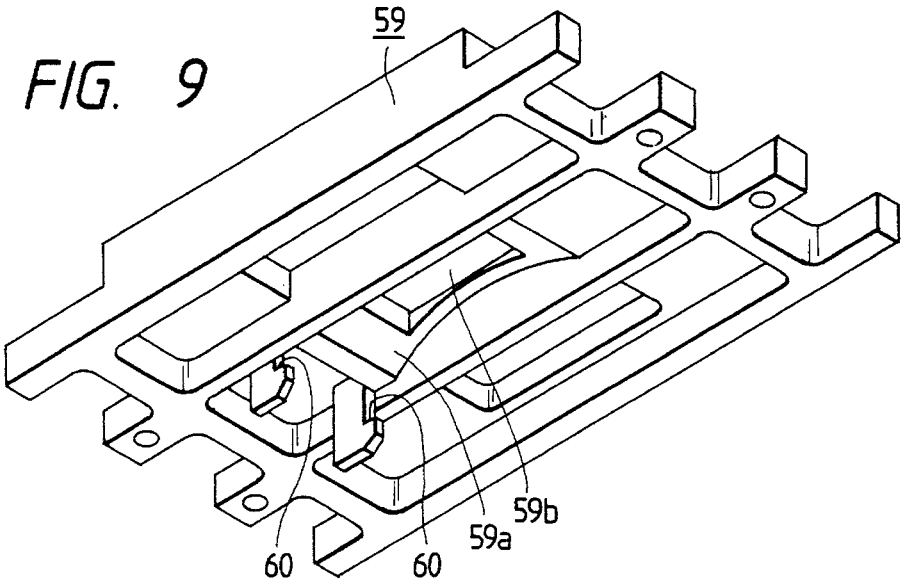
FIG. 9 is a perspective bottom view of the auxiliary cover shown in FIG. 8.

Another example of the circuit breaker, which forms a fourth embodiment of the invention, will be described with reference to FIGS. 7, 8 and 9. FIG. 7 is a sectional view showing the circuit breaker which is in an "on" state; FIG. 8 is a sectional view showing an auxiliary cover of the circuit breaker; and FIG. 9 is a perspective bottom view of the auxiliary cover. In those figures, parts corresponding functionally to those which have been described with reference to the conventional circuit breaker are therefore designated by the same reference numerals or characters.

In FIGS. 7 through 9, reference numeral 59 designates the aforementioned auxiliary cover, which has a guide 59*a* for guiding the arcuate base 7*a* of the handle 7, and an opening 59*b* through which the operating protrusion 7*a* is extended outside; and 60, recesses formed in the inner surface of the auxiliary cover, with which the end of the arcuate base 7*a* of the handle 7 is engaged when the latter 7 is at the "on" position.

As was described above, the auxiliary cover 59 has the recesses 60. Hence, when the handle 7 is set at the "on" position, the end of the arcuate base 7*a* of the handle is engaged with the recesses 60. That is, when the circuit breaker is in the "on" state, the auxiliary cover 59 cannot be opened engaging with the handle 7.

Fifth Embodiment

Figure 10:
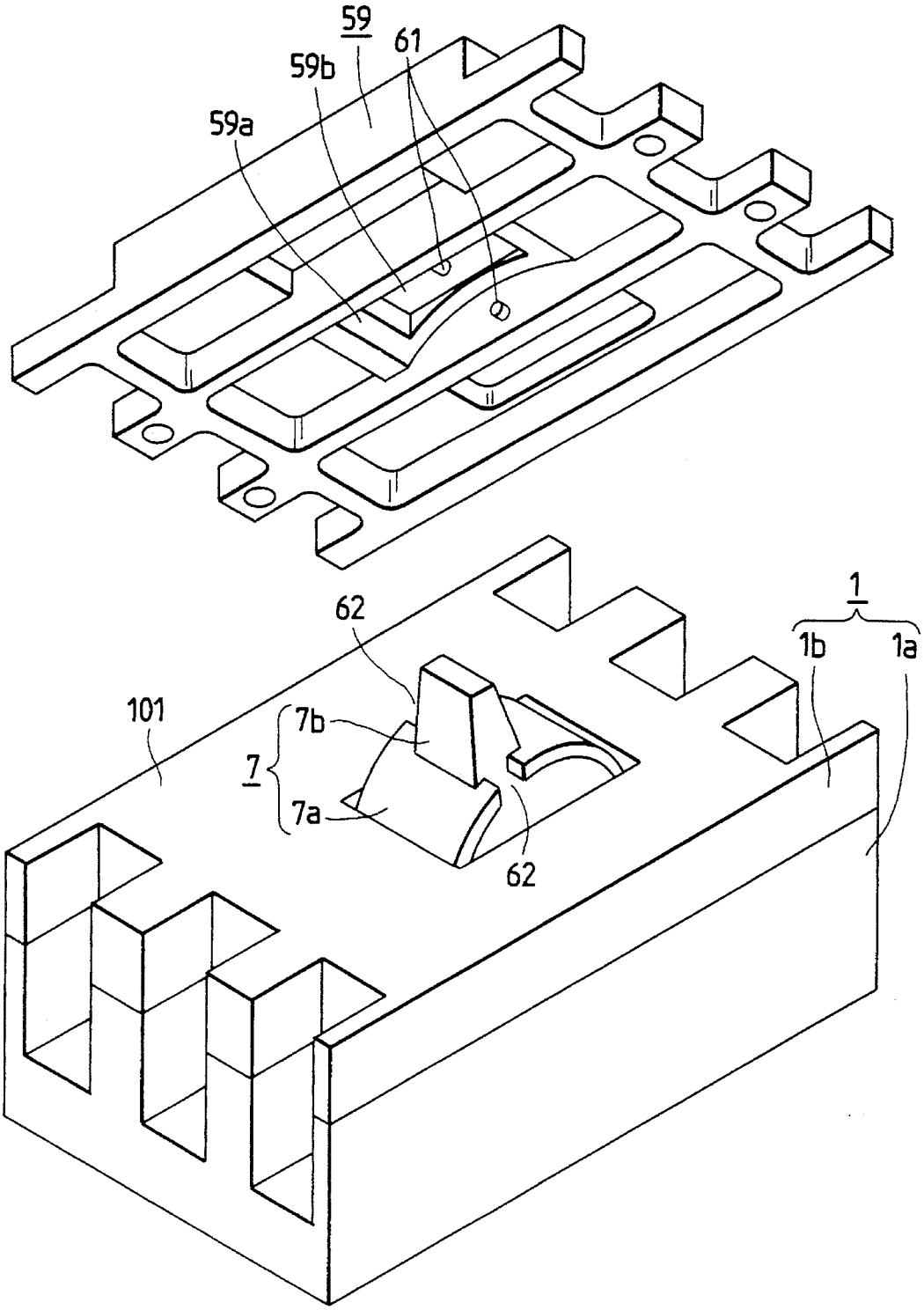
FIG. 10 is an exploded perspective view showing a fifth embodiment of the invention with its auxiliary cover removed.
Figure 11:
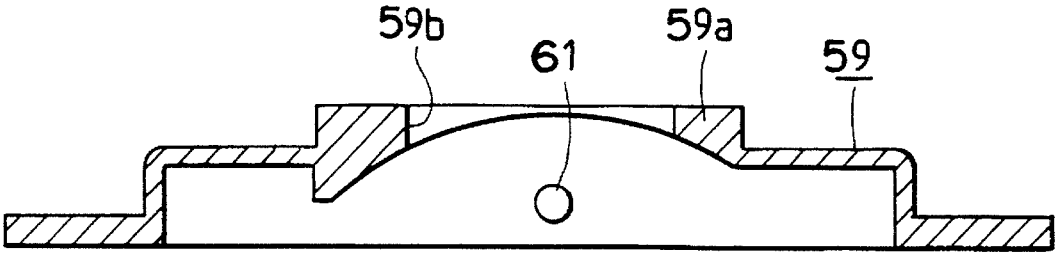
FIG. 11 is a sectional view of the auxiliary cover of the fifth embodiment.
Figure 12:
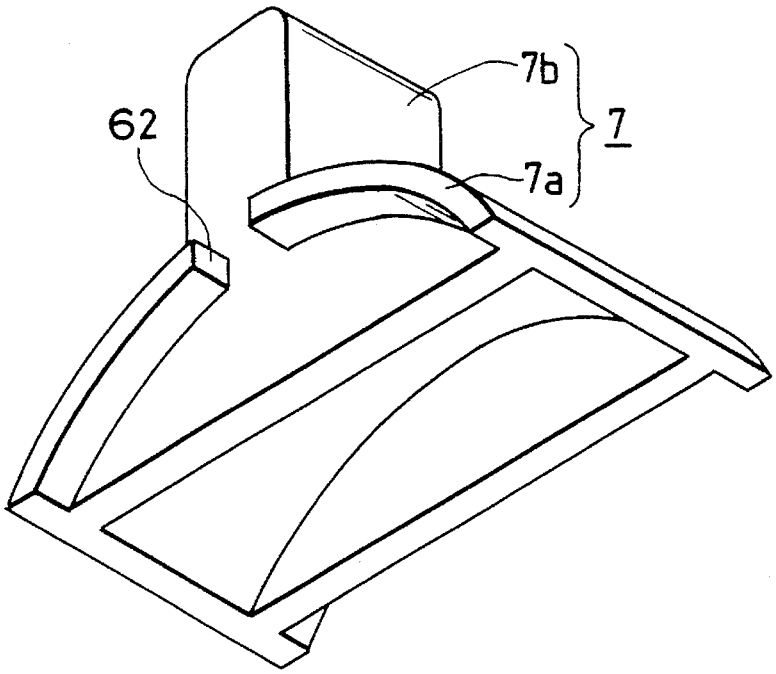
FIG. 12 is a perspective view showing a handle of the fifth embodiment.

Another example of the circuit breaker, which forms a fifth embodiment of the invention, will be described with reference to FIGS. 10, 11 and 12. FIG. 10 is an exploded perspective view showing the circuit breaker; FIG. 11, is a sectional view of an auxiliary cover of the circuit breaker; and FIG. 12 is a perspective view of the handle of the circuit breaker. In FIGS. 10 through 12, parts corresponding functionally to those which have been described with reference to the first embodiment are therefore designated by the same reference numerals or characters.

In FIGS. 10 through 12, reference numeral 61 designates a pair of pins which are protruded respectively from two opposite side walls of an opening 59*b* formed in the aforementioned auxiliary cover 59 of the circuit breaker; and 62, a pair of cuts formed in the arcuate base 7*b* of the handle 7 on both sides of the operating protrusion 7*b*, respectively, in such a manner that each of them has a width large enough to receive the pin 61.

As was described above, in the circuit breaker, the auxiliary cover 59 has the pair of pins 61. Hence, only when the handle 7 is at the "trip" position as shown in FIG. 10, the pins 61 are aligned with the cuts 62; that is, the auxiliary cover 59 can be opened only when the circuit breaker is in the "trip" state. In the case where the circuit breaker is in "an on" or "off" state, the pins 61 are engaged with the edges of the arcuate base 7*a* of the handle 7, thus inhibiting the opening of the auxiliary cover 59.

That is, the auxiliary cover 59 can be opened only when the circuit breaker is in the "trip" state. When an auxiliary device is installed on the circuit breaker, the latter is maintained unchanged in operation; i.e., the circuit breaker is maintained in the "trip" state, thus facilitating the installation of the auxiliary device.

Sixth Embodiment

Another example of the circuit breaker, which forms a sixth embodiment of the invention, will be described with reference to FIG. 13, in which parts corresponding functionally to those which have been described with reference to the fourth embodiment are therefore designated by the same reference numerals or characters.

Figure 13:
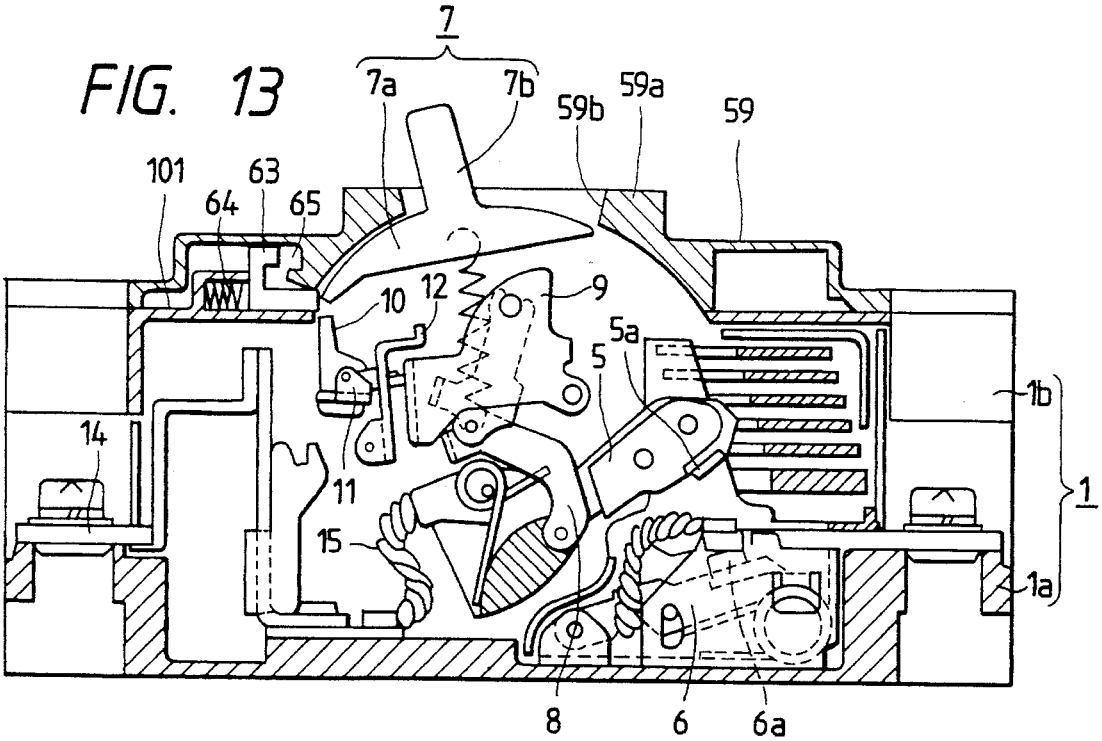
FIG. 13 is a sectional view showing a sixth embodiment of the invention which is in an "off" state.

In FIG. 13, reference numeral 63 denotes an actuator which is set in the surface 101 of the main cover 1*b* in such a manner that it is movable back and forth and urged by a spring 64 so as to be locked; and 65, a locking portion formed in the inner surface of the auxiliary cover 59, to which the actuator 63 is locked.

In the sixth embodiment, the main cover 1*b* has the actuator 63 as was described above. Hence, only when the handle 7 is at the "off" position as shown in FIG. 13, the actuator is retracted against the elastic force of the spring 64 being pushed by the end of the arcuate base 7*a* of the handle 7. That is, only when the circuit breaker is in the "off" state, the auxiliary cover 59 can be opened. In other words, when the circuit breaker is in an "on" or "trip" state, the actuator 63 is locked to the locking portion 65 by means of the spring 64, thus inhibiting the opening of the auxiliary cover 59.

With the sixth embodiment, the auxiliary cover can be opened only when the circuit breaker is in the "off" state. Hence, in installing an auxiliary device on the circuit breaker, the latter is maintained unchanged in operating state; i.e., the circuit breaker is maintained turned off, thus expediting the installation of the auxiliary device.

Seventh Embodiment

Figure 14:
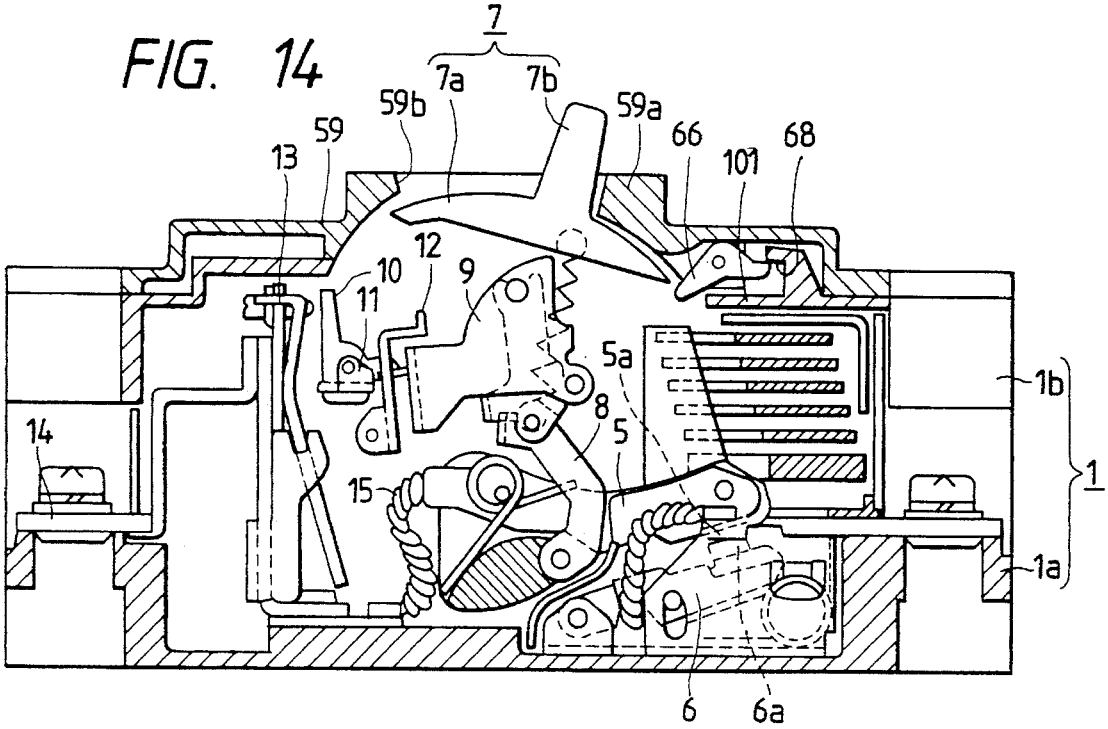
FIG. 14 is a sectional view showing a seventh embodiment of the invention which is in an "on" state.
Figure 15:
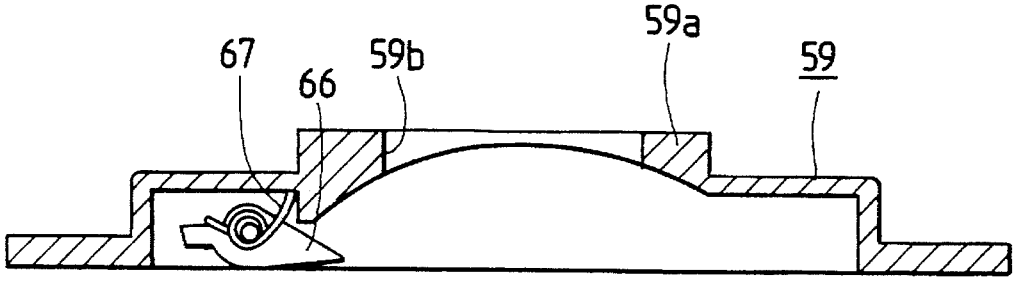
FIG. 15 is a sectional view of an auxiliary cover of the seventh embodiment.
Figure 16:
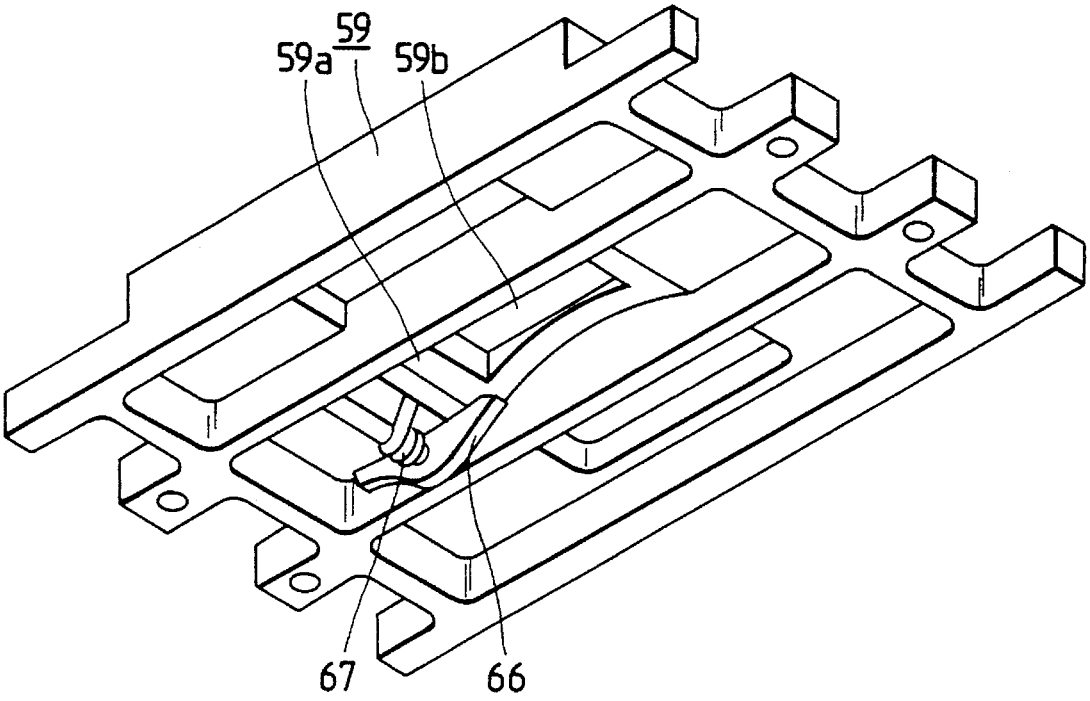
FIG. 16 is a perspective bottom view of the auxiliary cover shown in FIG. 15.

Another example of the circuit breaker, which forms a seventh embodiment of the invention, will be described with reference to FIGS. 14, 15 and 16. FIG. 14 is a sectional diagram showing the circuit breaker which is in "on" state; FIG. 15 is a sectional view of an auxiliary cover of the circuit breaker; and FIG. 16 is a perspective bottom view of the auxiliary cover. In those figures, parts corresponding functionally to those which have been described with reference to the fourth embodiment are therefore designated by the same reference numerals or characters.

In FIGS. 14 through 16, reference numeral 66 designates an actuator which is swingably mounted inside the auxiliary cover 59, the actuator 66 being urged by a spring 67 so as not to be locked; and 68, a locking portion formed in the surface 101 of the main cover. The actuator 66 is locked to the locking portion 68.

In the seventh embodiment, the auxiliary cover 59 has the actuator 66 in the above-described manner. Hence, only when the handle 7 is at the "on" position as shown in FIG. 14, the actuator 66, being pushed by the end of the arcuate base 7*a* of the handle 7, is engaged with the locking portion 68. Therefore, only when the circuit breaker is in the "on" state, the auxiliary cover 59 cannot be opened. When the circuit break is in the "off" or "trip" state, the actuator 66, being swung by the spring 67 as shown in FIGS. 15 and 16, is disengaged from the locking portion 68, thus permitting the opening of the auxiliary cover 59.

Eighth Embodiment

Figure 17:
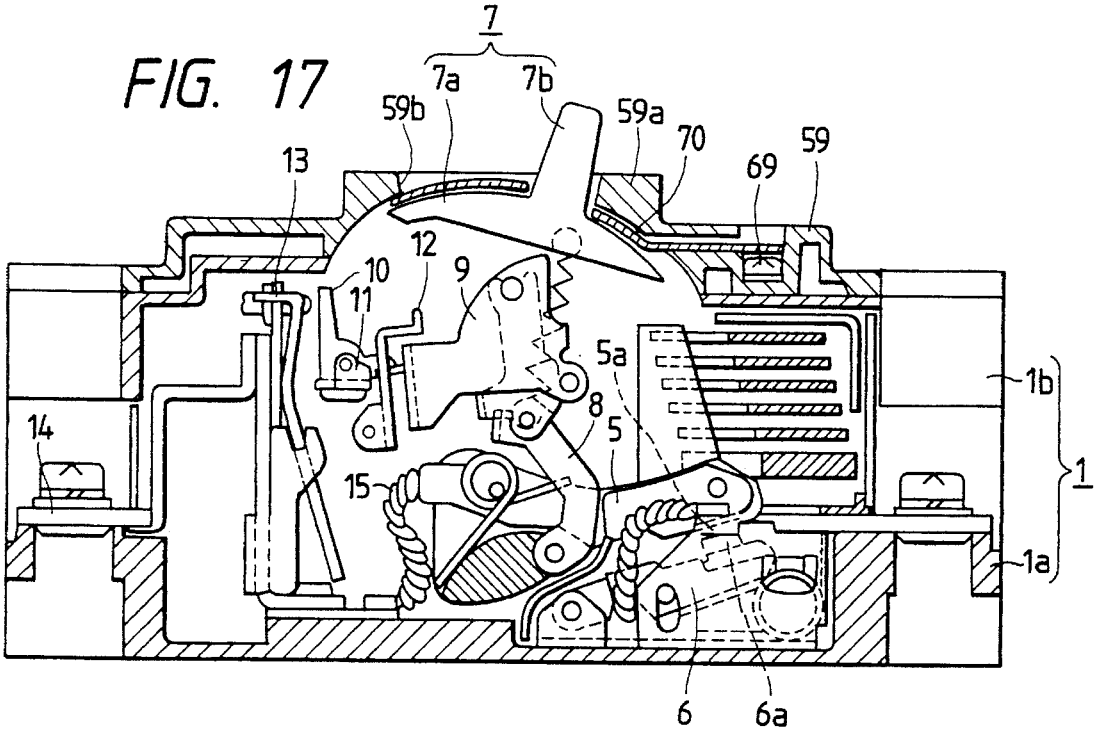
FIG. 17 is a sectional view of an eighth embodiment of the invention which is in an "on" state.
Figure 18:
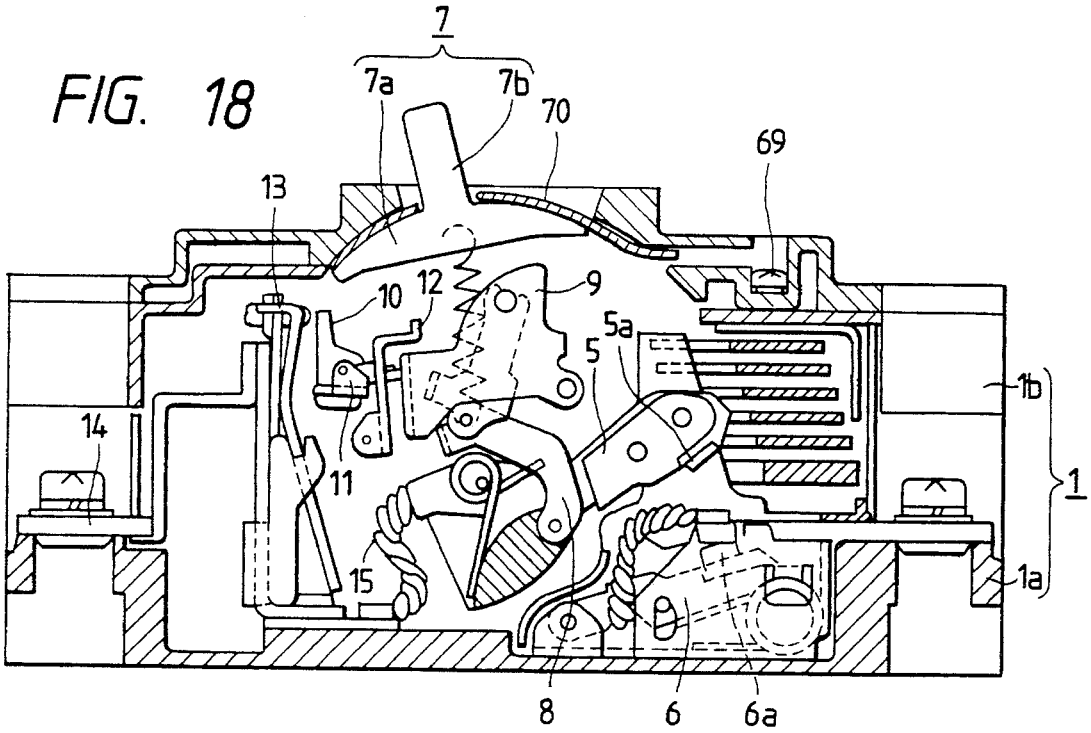
FIG. 18 is a sectional view of the eighth embodiment which is in an "off" state.

Another example of the circuit breaker, which forms an eighth embodiment of the invention, will be described with reference to FIGS. 17 and 18. FIG. 17 is a sectional view showing the circuit breaker which is in the "on" state, and FIG. 18 is also a sectional view of the circuit breaker which is in the "off" state. In FIGS. 17 and 18, parts corresponding functionally to those which have been described with reference to the fourth embodiment are therefore designated by the same reference numerals or characters.

In FIGS. 17 and 18, reference numeral 69 designates mounting screws which detachably mount the auxiliary cover 59 on the main cover 1*b*; and 70, a slider which is movable back and forth together with the handle 7. The slider 70 is so shaped that it covers the mounting screws 69 only when the handle is at the "on" position.

In the eighth embodiment, the slide 70 is provided for the handle 7 in the above-described manner. Hence, when the handle is at the "on" position, the slider 70 covers the mounting screws 69, thus inhibiting removal of the mounting screws 69; that is, the auxiliary cover 59 cannot be opened. When the handle is at the "off" position, the mounting screws 69 are not covered by the slider 70 as shown in FIG. 18, and therefore the mounting screws 69 can be removed to open the auxiliary cover 59. Similarly, when the handle is at the "trip" position, the mounting screws 69 are not covered by the slider 70, and therefore the auxiliary cover 59 can be opened.

Ninth Embodiment

Figure 19:
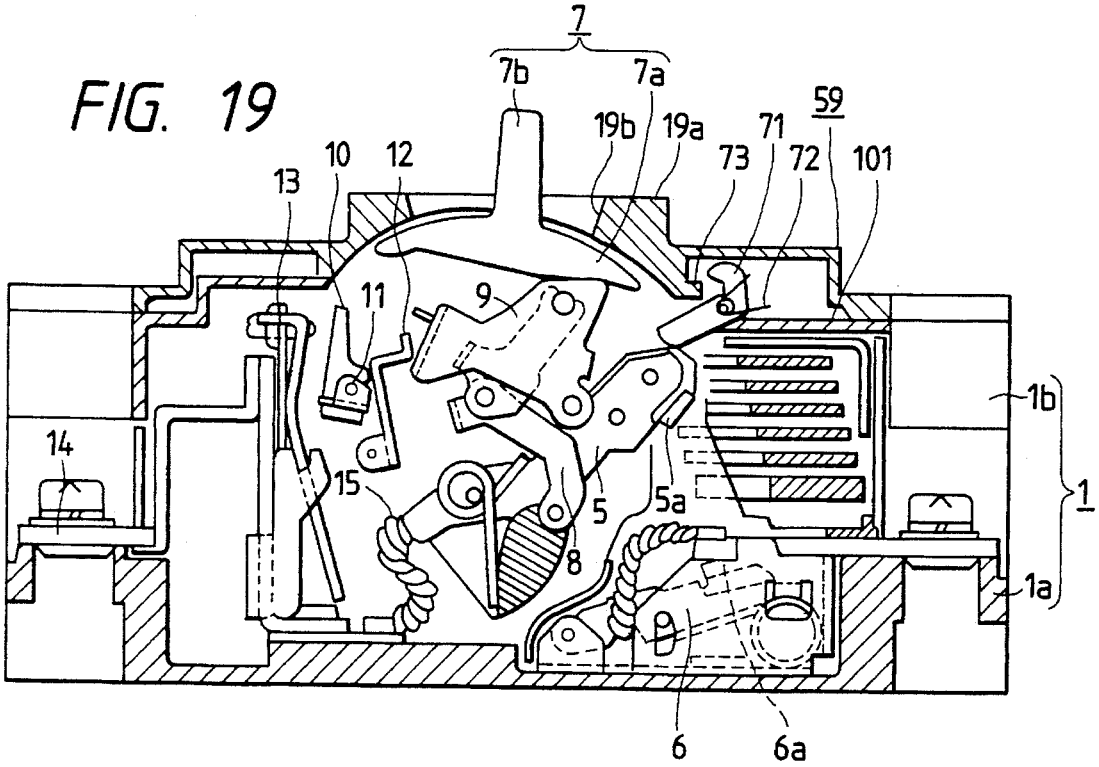
FIG. 19 is a sectional view of a ninth embodiment of the invention which is in a "trip" state.
Figure 20:
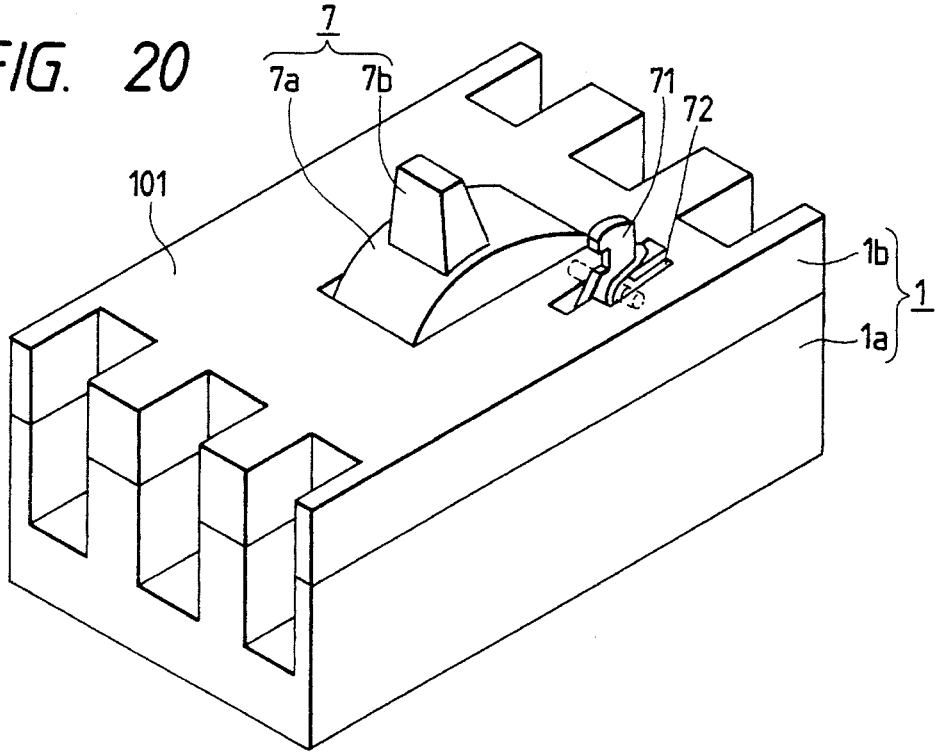
FIG. 20 is a perspective view of the ninth embodiment with its auxiliary cover removed.
Figure 21:
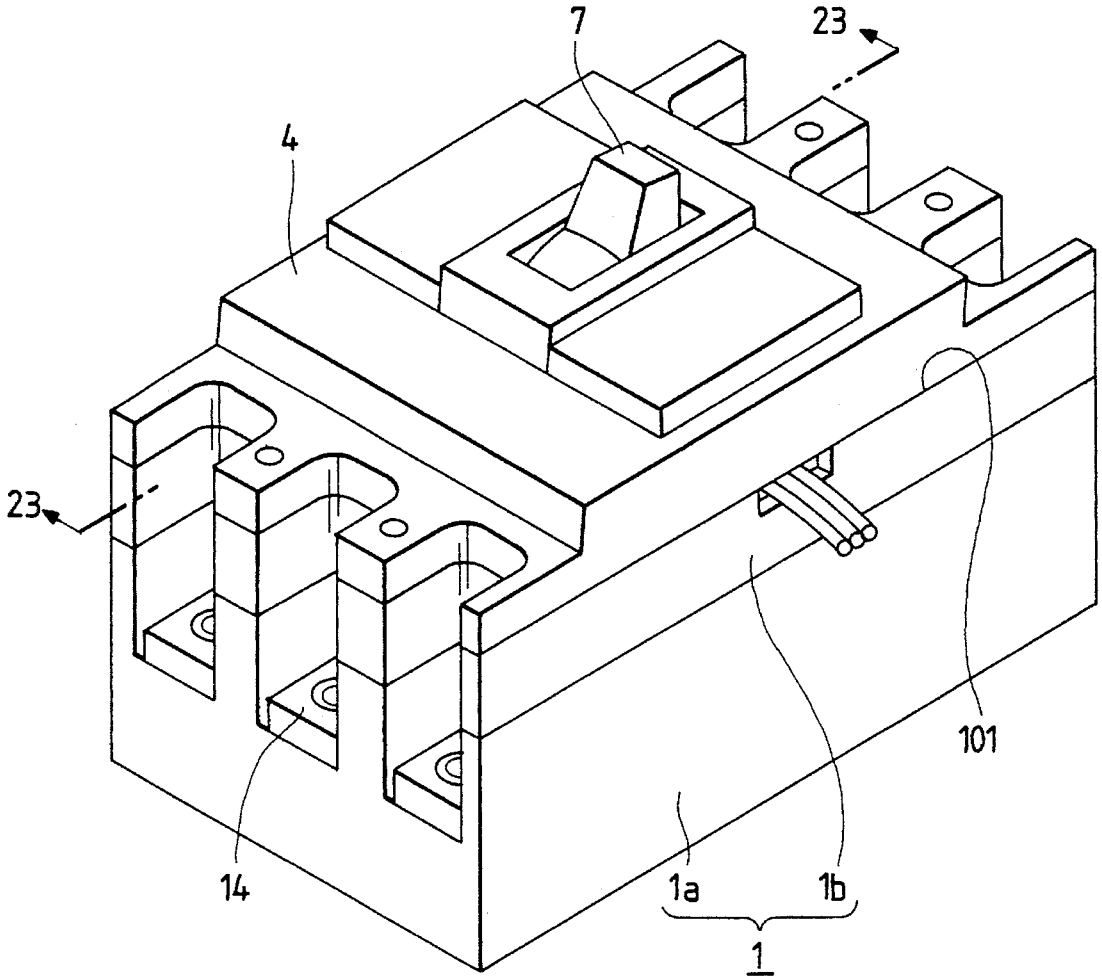
FIG. 21 is a perspective view showing the external appearance of a conventional circuit breaker.
Figure 22:
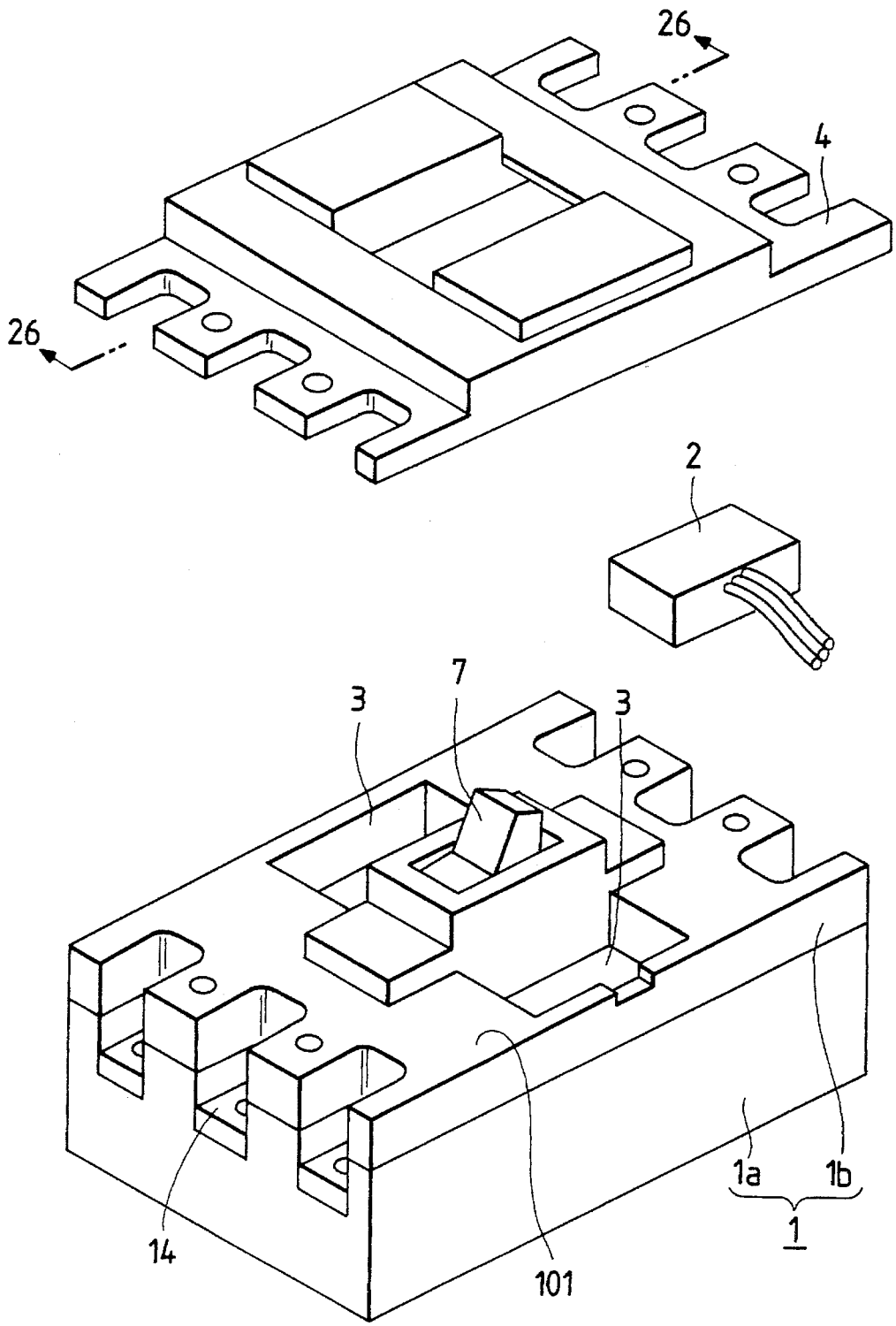
FIG. 22 is an exploded perspective view of the conventional circuit breaker.
Figure 23:
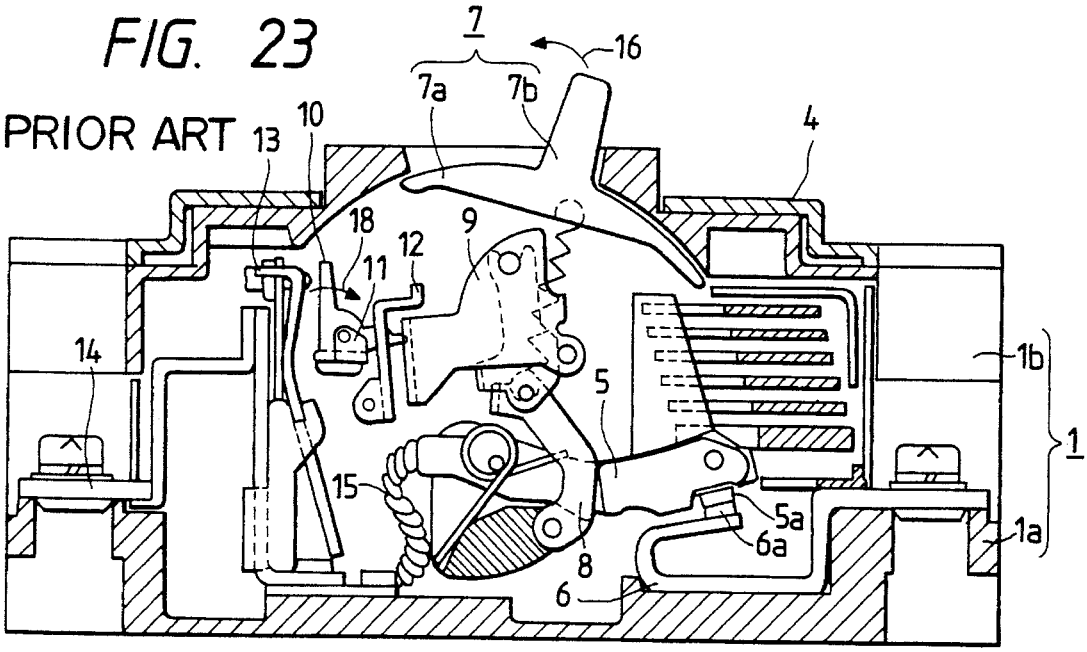
FIG. 23 PRIOR ART
FIG. 23 is a sectional view taken along line 23—23 in FIG. 21, showing the circuit breaker which is in an "on" state.
Figure 24:
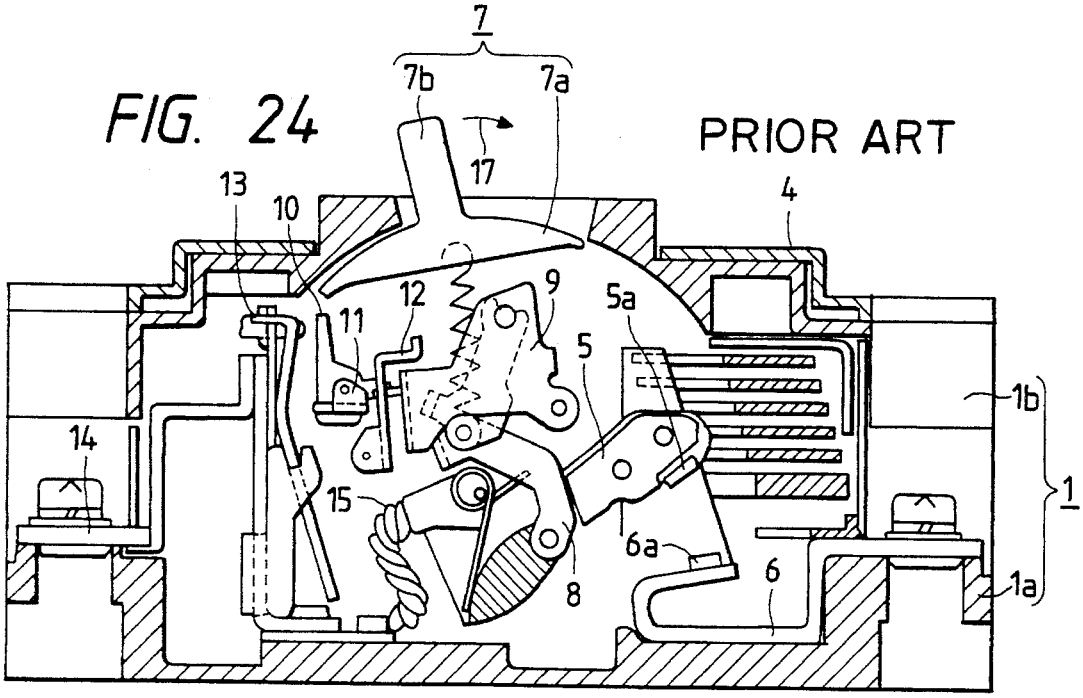
FIG. 24 PRIOR ART
FIG. 24 is also a sectional view taken along line 23—23 in FIG. 21, showing the circuit breaker which is in an "off" state.
Figure 25:
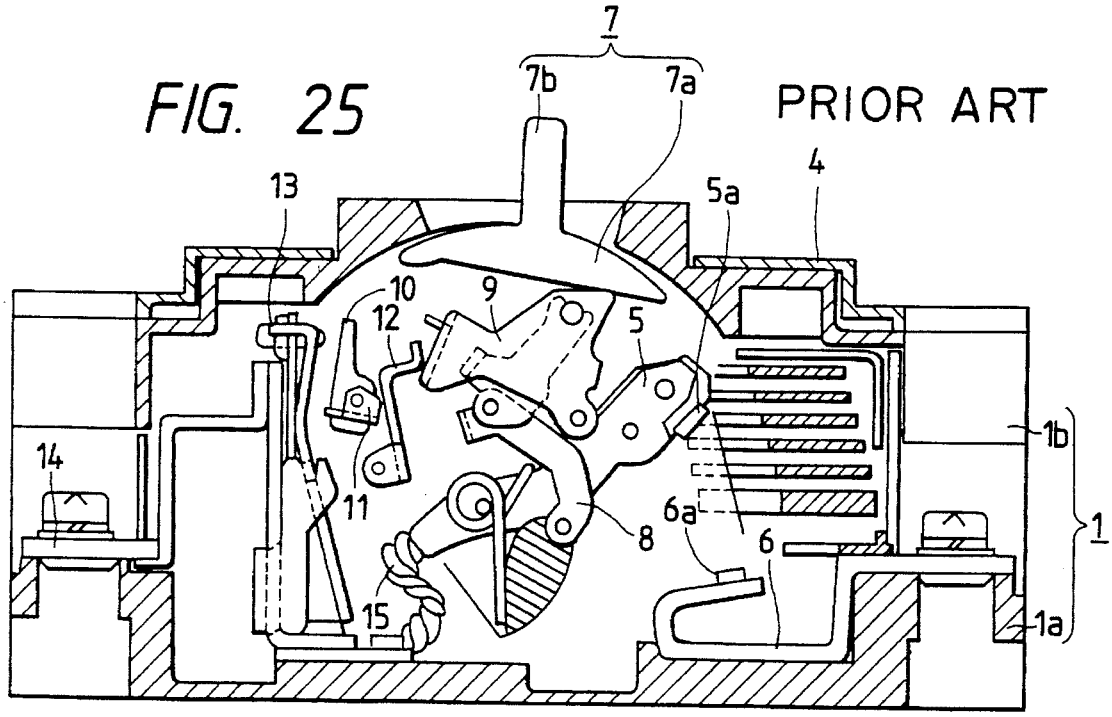
FIG. 25 PRIOR ART
FIG. 25 is a sectional view taken along line 23—23 in FIG. 21, showing the circuit breaker which is in a"trip" state.
Figure 26:
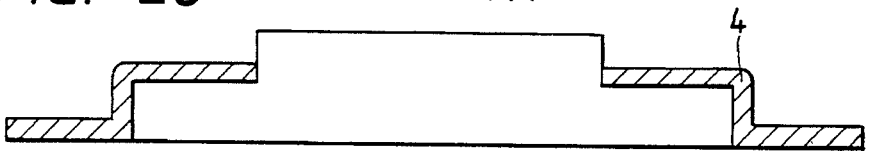
FIG. 26 PRIOR ART
FIG. 26 is a sectional view taken along line 26—26 in FIG. 22, showing an auxiliary cover.
Figure 27:
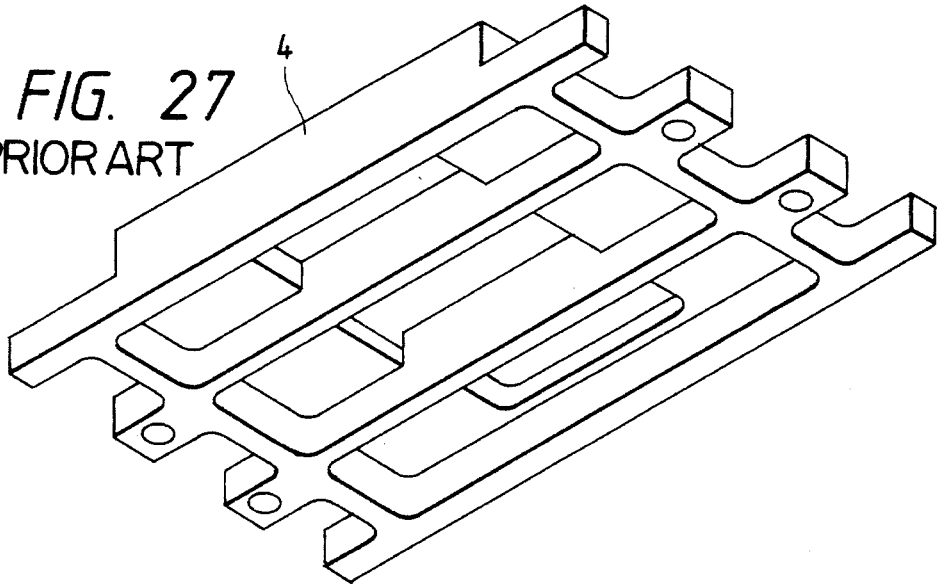
FIG. 27 PRIOR ART
FIG. 27 is a perspective bottom view of the auxiliary cover.

Another example of the circuit breaker, which forms a ninth embodiment of the invention, will be described with reference to FIGS. 19 and 20. FIG. 19 is a sectional view of the circuit breaker which is in a "trip" state, and FIG. 20 is a perspective view of the circuit breaker with its auxiliary cover removed. In FIGS. 19 and 20, parts corresponding functionally to those which have been described with reference to the fourth embodiment are therefore designated by the same reference numerals or characters.

In FIGS. 19 and 20, reference numeral 71 denotes an actuator which is swingably mounted on the surface 101 of the main cover 1*b*, the actuator being urged by a spring 72 so as to be locked; and 73, a locking portion formed on the inner surface of the auxiliary cover 59. The actuator 71 is locked to the locking portion 73.

In the ninth embodiment, the actuator 71 is provided on the main cover 1*b* in the above-described manner. Hence, when the circuit breaker is tripped, as shown in FIG. 19 the actuator 71, being swung against the elastic force of the spring 71 by the movable piece 5, is disengaged from the locking portion 73, so that the auxiliary cover 59 can be opened. In the case where the circuit breaker is in an "on" or "off" state, the amount of rise of the movable piece 5 is so small that the actuator 71 is not swung; that is, the actuator 71 is kept locked to the locking portion 73 by the spring 72. Therefore, the auxiliary cover 59 cannot be opened.

That is, the auxiliary cover 59 can be opened only when the circuit breaker is in the "trip" state. Hence, in installing an auxiliary device on the circuit breaker, the latter is maintained unchanged in operation (the circuit breaker is maintained in the "trip" state), thus expediting the installation of the auxiliary device.

In some circuit breakers, the amount of rise of the movable piece is the same in tripping the circuit breaker and in turning it off. In this case, the auxiliary cover 59 cannot be opened only when the circuit breaker is in the "off" state.

As was described above, in the fourth through ninth embodiments, it is inhibited to open the auxiliary cover when the circuit breaker is in the "on" state. Therefore, installation of an auxiliary device on the circuit breaker can be achieved with high security and with high reliability. While this invention has been illustrated and described in accordance with a preferred embodiment, it is recognized that variations and changes may be made therein without departing from the invention as set forth in the claims

What is claimed is:

1. A circuit breaker comprising:

a casing including a base and a main cover secured to the base, the casing accommodating a circuit breaking mechanism, the main cover having a recess formed therein;

an auxiliary electrical device received in the recess;

an auxiliary cover removably mounted on the main cover in such a manner as to close the recess; and means for preventing the auxiliary cover from being removed unless the circuit breaker is not in an ON state.

2. The circuit breaker according to claim 1, wherein said means includes a link mechanism for putting the circuit breaker into either one of OFF state and TRIP state in conjunction with the opening operation of the auxiliary cover.

3. The circuit breaker according to claim 1, wherein the preventing means includes a lock mechanism, the lock mechanism locking the auxiliary cover to the main cover when the circuit breaker is in the ON state.

4. The circuit breaker according to claim 3, wherein the lock mechanism permits removal of the auxiliary cover from the main cover when the circuit breaker is in either one of an OFF state and a TRIP state.

5. The circuit breaker according to claim 1, wherein said means includes a mechanism for covering a fixing screw when said circuit breaker is in the On state, the fixing screw securing the auxiliary cover to the main cover.

6. The circuit breaker according to claim 5, wherein said mechanism permits removal of the fixing screw when the circuit breaker is in either one of OFF state and TRIP state.

7. The circuit breaker according to claim 1, further comprising an auxiliary device, the auxiliary device being received in the recess.

8. The circuit breaker according to claim 1, wherein the preventing means permits removal of the auxiliary cover from the main cover when the circuit breaker is in an OFF state.

9. The circuit breaker according to claim 1, wherein the preventing means permits removal of the auxiliary cover from the main cover when the circuit breaker is in a TRIP state.

10. The circuit breaker according to claim 1, wherein the preventing means includes a handle and a recess formed in the auxiliary cover, the handle being movable to place the circuit breaking mechanism in the ON state and having a base portion, at least a portion of the base portion of the handle engaging with the recess when the handle is moved to place the circuit breaking mechanism in the ON state.

11. A circuit breaker comprising:

a casing including a base and a main cover secured to the base, the main cover having a recess therein;

an auxiliary cover removably mounted on the main cover, the auxiliary cover having a closed condition in which the auxiliary cover closes the recess and an open condition in which the recess is not closed; and a circuit breaking mechanism at least partially disposed inside of the casing, the circuit breaking mechanism having an ON state and a second state, wherein the circuit breaking mechanism cannot be in the ON state when the auxiliary cover is in the open condition.

12. The circuit breaker according to claim 11, wherein the circuit breaking mechanism is adapted to be in the second state both when the auxiliary cover is in the closed condition and when the auxiliary cover is in the open condition.

13. The circuit breaker according to claim 11, further comprising a movable handle for selectively placing the circuit breaking mechanism in one of the 0N state and the second state, a portion of the handle engaging with the auxiliary cover when the handle is moved to place the circuit breaking mechanism in the ON state such that the auxiliary cover is prevented from being placed in the open condition.

14. The circuit breaker according to claim 13, wherein, when the handle is moved to place the circuit breaking mechanism in the second state, the portion of the handle and the auxiliary cover disengage to permit placing the auxiliary cover in the open condition.

15. A circuit breaker comprising:

a circuit breaking mechanism including an ON state and a second state;

a housing for the circuit breaking mechanism, the housing having a recess therein and including an attached cover for covering the recess, the cover being movable between a closed condition and an open condition; and an auxiliary electrical device received in the recess;

wherein the circuit breaking mechanism cannot be in the ON state when the cover is in the open condition.

16. The circuit breaker according to claim 15, wherein the second state is an OFF state, the circuit breaking mechanism being adapted to be in the OFF state both when the cover is in the closed condition and when the cover is in the open condition.

17. The circuit breaker according to claim 15, wherein the second state is a TRIP state, the circuit breaking mechanism being adapted to be in the TRIP state both when the cover is in the closed condition and when the cover is in the open condition.

18. The circuit breaker according to claim 15, further comprising a movable handle for selectively placing the circuit breaking mechanism in one of the 0N state and the second state, a portion of the handle engaging with the cover when the handle is moved to place the circuit breaking mechanism in the ON state such that the cover is prevented from being placed in the open condition.

19. The circuit breaker according to claim 18, wherein, when the handle is moved to place the circuit breaking mechanism in the second state, the portion of the handle and the cover disengage to permit placing the cover in the open condition.

* * * * *